US008120261B2

(12) United States Patent
Park et al.

(10) Patent No.: US 8,120,261 B2
(45) Date of Patent: Feb. 21, 2012

(54) ORGANIC ELECTROLUMINESCENCE DISPLAY AND DRIVING METHOD THEREOF

(75) Inventors: Sung-Cheon Park, Suwon-si (KR); Wook Lee, Suwon-si (KR)

(73) Assignee: Samsung Mobile Display Co., Ltd. (KR)

( * ) Notice: Subject to any disclaimer, the term of this patent is extended or adjusted under 35 U.S.C. 154(b) by 601 days.

(21) Appl. No.: 12/283,551

(22) Filed: Sep. 11, 2008

(65) Prior Publication Data

US 2009/0140661 A1 Jun. 4, 2009

(30) Foreign Application Priority Data

Dec. 4, 2007 (KR) ..... 10-2007-0124948

(51) Int. Cl.
*G09G 3/10* (2006.01)

(52) U.S. Cl. ..... 315/169.3; 315/166; 315/176

(58) Field of Classification Search ..... 315/169.3, 315/160–176
See application file for complete search history.

(56) References Cited

U.S. PATENT DOCUMENTS

| | | | | |
|---|---|---|---|---|
| 6,339,415 | B2 * | 1/2002 | Ishizuka | 345/76 |
| 7,042,164 | B2 * | 5/2006 | Yazawa | 315/169.3 |
| 2005/0012698 | A1 * | 1/2005 | Takahashi | 345/77 |
| 2005/0237001 | A1 * | 10/2005 | Hayafuji | 315/169.2 |
| 2006/0066531 | A1 * | 3/2006 | Park et al. | 345/76 |

FOREIGN PATENT DOCUMENTS

| | | | |
|---|---|---|---|
| CN | 1753069 | A | 3/2006 |
| EP | 1640965 | A1 | 3/2006 |
| JP | 09-322529 | (A) | 12/1997 |
| JP | 2003-150129 | (A) | 5/2003 |
| JP | 2003-316328 | (A) | 11/2003 |
| JP | 2004-341574 | (A) | 12/2004 |
| JP | 2005-062618 | A | 3/2005 |

OTHER PUBLICATIONS

Office Action issued on Mar. 22, 2010 in Chinese Patent Application No. 200810166362.2 claiming priority to the corresponding Korean Patent Application No. 10-2007-0124948.

Japanese Office Action dated Jul. 26, 2011 for Japanese Patent Application No. JP 2008-274675 which shares priority of Korean Patent Application No. KR 10-2007-0124948 with captioned U.S. Appl. No. 12/283,551.

Japanese Office Action dated Dec. 6, 2011 for Japanese Patent Application No. JP 2008-274675 which shares priority of Korean Patent Application No. KR 10-2007-0124948 with captioned U.S. Appl. No. 12/283,551.

* cited by examiner

*Primary Examiner* — Jason M Crawford
(74) *Attorney, Agent, or Firm* — Knobbe Martens Olson & Bear LLP

(57) ABSTRACT

An organic electroluminescence display device is disclosed. The display comprises pixels which emit light according to data signals by controlling current from a pixel power supply through an organic light emitting diode, and to a ground power supply. In order to eliminate an initial glare, the pixel power supply is gradually provided to the pixels, and after a delay, the ground power supply is then gradually provided to the pixels.

19 Claims, 4 Drawing Sheets

ORGANIC ELECTROLUMINESCENCE DISPLAY AND DRIVING METHOD THEREOF

CROSS-REFERENCE TO RELATED APPLICATIONS

This application claims the benefit of Korean Patent Application No. 10-2007-0124948 filed on Dec. 4, 2007 in the Korean Intellectual Property Office, the entire content of which is incorporated herein by reference.

BACKGROUND

1. Field

The field relates to an organic electroluminescence display and a driving method thereof preventing flashover at an initial driving thereof.

2. Description of the Related Technology

With developments in technology relating to thin film transistors and semiconductors, active matrix type flat-panel displays using a thin film transistor have been widely used. In particular, an organic electroluminescence display, has excellent properties of luminous efficiency, brightness, viewing angle, and rapid response speed.

The organic electroluminescence display displays images by using a plurality of organic light emitting diodes (OLED). The respective organic light emitting diodes include an anode electrode, a cathode electrode and an organic light emitting layer positioned therebetween and light is emitted by means of the recombination of electrons and holes.

FIG. 1 is a graph showing voltage levels according to time sequence of power generally supplied to an organic electroluminescence display. Referring to FIG. 1, the organic electroluminescence display is driven by receiving a pixel power supply ELVDD and a ground power supply ELVSS having voltage lower than the pixel power supply ELVDD.

The pixel power supply ELVDD is generated by boosting a voltage so that the ELVDD voltage levels are gradually raised, as shown in FIG. 1. And, the ground power supply ELVSS may be gradually lowered.

The organic electroluminescence display operates in response to the pixel power supply ELVDD and the ground power supply ELVSS. However, at start up the difference of the voltage levels of the pixel power supply ELVDD and the ground power supply ELVSS increases over time. As a result, the highest pixel power supply ELVDD and the lowest ground power supply ELVSS are provided to the pixels in the last horizontal line of the organic electroluminescence display.

Therefore, the lower portion of the organic electroluminescence has a relatively high brightness, which is perceived as glare.

SUMMARY OF CERTAIN INVENTIVE ASPECTS

One aspect is an organic electroluminescence display, configured to operate in response to data signals, scan signals, a pixel power supply and a ground power supply, the display including means for displaying an image, means for supplying the pixel power supply to the means for displaying according to an enable signal, means for supplying the ground power supply to the means for displaying according to the enable signal, means for applying the enable signal to the means for supplying the pixel power supply and to the means for supplying the ground power supply, and means for delaying the enable signal before applying the enable signal to the means for supplying the ground power supply, where the means for supplying the pixel power supply to the means for displaying supplies the pixel power supply to the means for displaying before the means for supplying the ground power supply to the means for displaying supplies the ground power supply to the means for displaying.

Another aspect is an organic electroluminescence display, including a pixel unit configured to control current between a pixel power supply and a ground power supply according to data signals and scan signals, where light is emitted according to the amount of the current. The display also includes a DC-DC converter configured to generate and sequentially output the pixel power supply and the ground power supply, where the ground power supply is output after the pixel power supply. The DC-DC converter includes a first power supply unit configured to generate the pixel power supply after receiving enable signals and boosting an input voltage, a second power supply unit configured to output the ground power supply after receiving the enable signals and dropping the input voltage, a stabilization capacitor coupled to an output terminal of the first power supply unit and configured to stabilize the output voltage of the first power supply unit, and a delay element configured to delay the enable signals for a time before transferring them to the second power supply unit.

Another aspect is a driving method of an organic electroluminescence display, configured to operate according to data signals, scan signals, a pixel power supply and a ground power supply. The driving method includes generating the pixel power supply by boosting an input voltage according to enable signals, generating the ground power supply after receiving the enable signals, delaying the enable signals before generating the ground power supply, and receiving the pixel power supply and the ground power supply to allow current to flow in the pixels.

Another aspect is an organic electroluminescence display, including a pixel unit configured to control current between a pixel power supply and a ground power supply, where light is emitted according to the amount of the current, and a DC-DC converter configured to sequentially output the pixel power supply and the ground power supply, where the ground power supply is output after a delay relative to the pixel power supply.

BRIEF DESCRIPTION OF THE DRAWINGS

The accompanying drawings, together with the specification, illustrate exemplary embodiments, and, together with the description, serve to explain certain principles of the present invention.

DETAILED DESCRIPTION OF PREFERRED EMBODIMENTS

Figure 1:
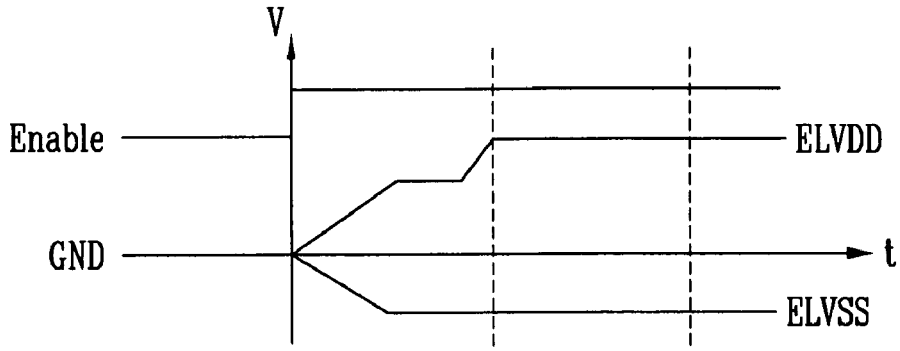
FIG. 1 is a graph showing voltage levels according to time sequence of power generally supplied to an organic electroluminescence display.

Hereinafter, certain exemplary embodiments will be described with reference to the accompanying drawings.

Herein, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals generally refer to like elements throughout.

Hereinafter, exemplary embodiments will be described with reference to the accompanying drawings.

Figure 2:
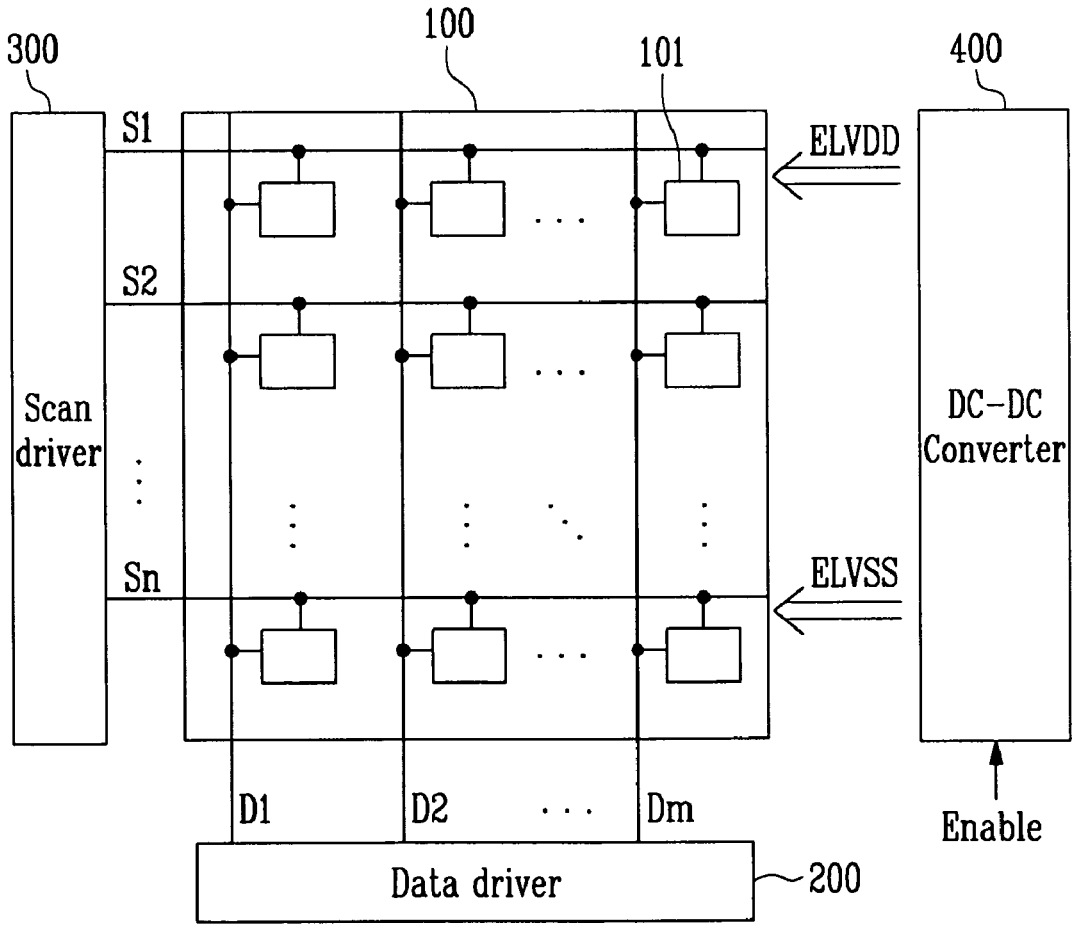
FIG. 2 is a block diagram showing the structure of an exemplary organic electroluminescence display.

FIG. 2 is a schematic view showing a structure of an organic electroluminescence display. Referring to FIG. 2, the organic electroluminescence display includes a pixel unit 100, a data driver 200, a scan driver 300, and a DC-DC converter 400.

The pixel unit 100 includes a plurality of pixels 101, wherein each pixel 101 includes an organic light emitting diode (not shown) configured to emit light corresponding to the current flow therethrough. Also, the pixel unit 100 further includes a plurality of n scan lines S1, S2, . . . , Sn−1, and Sn arranged in a row direction and configured to transfer scan signals, and a plurality of m data lines D1, D2, . . . , Dm−1, and Dm arranged in a column direction and configured to transfer data signals. Also, the pixel unit 100 is driven by receiving a pixel power supply ELVDD and a ground power supply ELVSS having voltage lower than the pixel power supply ELVDD.

The data driver 200 applies the data signals to the pixel unit 100. The data driver 200 as above receives the video signals having red, blue and green components to generate the data signals. And, the data driver 200 is coupled to the data lines D1, D2, . . . , Dm−1, and Dm of the pixel unit 100 to apply the generated data signals to the pixel unit 100.

The scan driver 300 applies scan signals to the pixel unit 100. The scan driver 300 is coupled to the scan lines S1, S2, . . . , Sn−1, and Sn to sequentially transfer the scan signals to each row of the pixel unit 100. The pixel 101 receiving the scan signals receives the data signals output from the data driver 200 so that driving current is generated in the pixel 101 to flow to an organic light emitting diode.

The DC-DC converter 400 transfers the pixel power supply ELVDD and the ground power supply ELVSS to the pixel unit 100. Each circuit of the pixel unit 100 receiving the pixel power supply ELVDD and the ground power supply ELVSS generates current corresponding to the data signals and allows light to be emitted in the organic light emitting diode according to the generated current. The DC-DC converter 400 receives enable signals to generate the pixel power supply ELVDD and the ground power supply ELVSS. However, the DC-DC converter 400 generates the pixel power supply ELVDD and the ground power supply ELVSS at different times.

Figure 3:
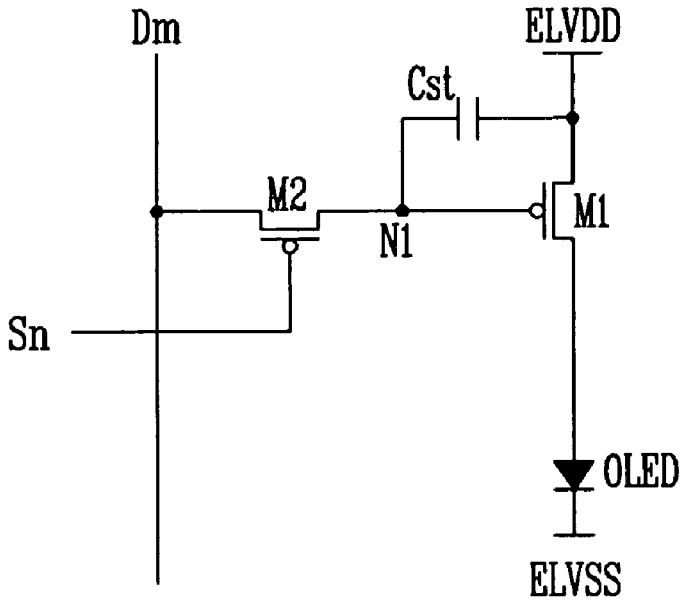
FIG. 3 is a schematic diagram of a pixel used in an embodiment of the organic electroluminescence display of FIG. 1.

FIG. 3 is a circuit view showing an embodiment of a pixel used in an organic electroluminescence display of FIG. 1. Referring to FIG. 3, the pixel includes a first transistor M1, a second transistor M2, a capacitor Cst, and an organic light emitting diode OLED.

A source electrode of the first transistor M1 is coupled to a pixel power supply ELVDD, a drain electrode thereof is coupled to the organic light emitting diode OLED, and a gate electrode thereof is coupled to a first node N1. The first transistor M1 controls the amount of current flowing from the source electrode to the drain electrode according to the voltage of the first node N1.

A source electrode of the second transistor M2 is coupled to a data line Dm, a drain electrode thereof is coupled to the first node N1, and a gate electrode thereof is coupled to a scan line Sn. The second transistor M2 transfers the data signals from the data line Dm to the first node N1 according to the scan signals on the scan line Sn.

A first electrode of the capacitor Cst is coupled to the pixel power supply ELVDD, and a second electrode thereof is coupled to the first node N1. The capacitor Cst allows the voltage of the first node N1 to be maintained for a time and thus, allows the first node N1 to maintain the voltage of the data signals for a time after the voltage of the data signals is transferred to the first node N1.

Therefore, while the second transistor M2 is turned on according to the scan signals, although the second transistor M2 is turned off after the voltage of the data signal is transferred to the first node N1, the voltage of the data signal is maintained for a time because of the capacitor Cst. The voltage of the first node N1 has the voltage of the data signal so that the first transistor M1 allows current corresponding to the data signal to flow from the source electrode to the drain electrode.

An anode electrode of the organic light emitting diode OLED is coupled to the drain electrode of the first transistor M1, and a cathode electrode thereof is coupled to the ground power supply ELVSS. The organic light emitting diode OLED receives current generated from the first transistor M1 to emit light.

Figure 4:
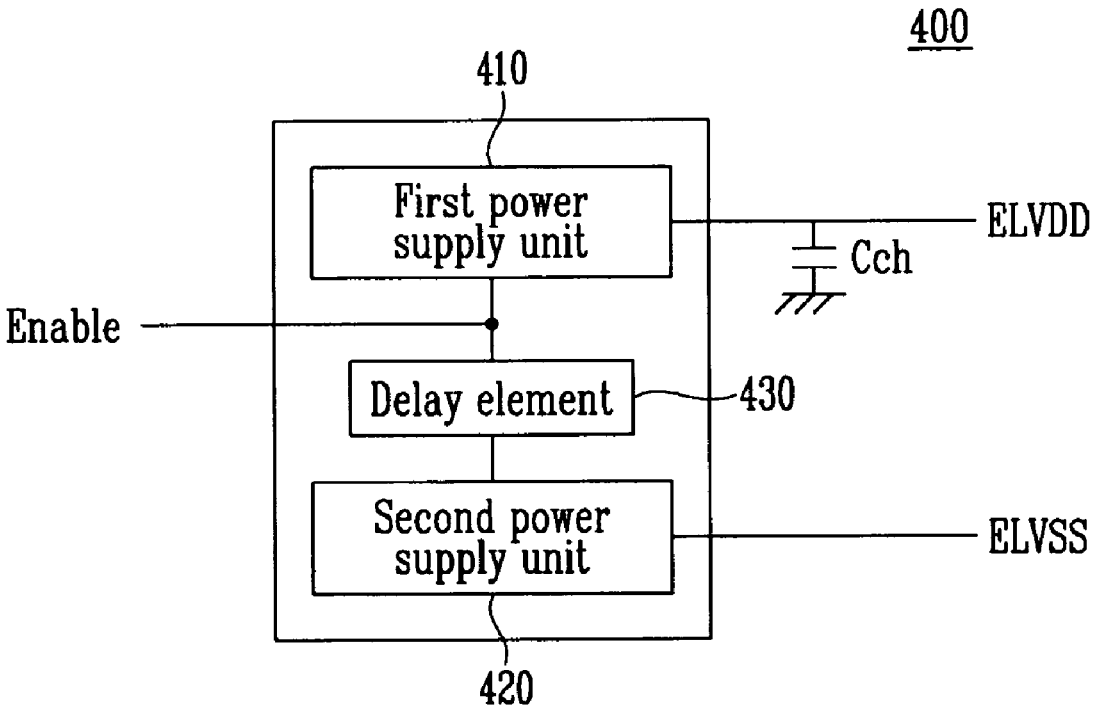
FIG. 4 is a block diagram for an embodiment of a DC-DC converter of FIG. 2.

FIG. 4 is a block diagram view showing an embodiment structure of a DC-DC converter of FIG. 2. Referring to FIG. 4, the DC-DC converter 400 includes a first power supply unit 410, a second power supply unit 420, a delay element 430, and a stabilization capacitor Cch.

The first power supply unit 410, which receives an input voltage to generate a first power supply (pixel power supply) ELVDD, may, for example, boost the input voltage to generate the first power supply ELVDD.

The second power supply unit 420, which receives an input voltage to generate a second power supply (ground power supply) ELVSS, may, for example, invert the input voltage to generate the second power supply ELVSS having a low voltage.

The first power supply unit 410 and a second power supply unit 420 as above receive enable signals Enable to determine whether to operate.

The delay element 430 delays the time that the enable signals Enable are transferred to the second power supply unit 420. Accordingly, the delay element 430 delays the ground power supply ELVSS so as to be output from the second power supply unit 420 after a certain time elapses after the pixel power supply ELVDD is generated in the first power supply unit 410. In some embodiments, the delay element 430 may comprise one or more of an inverter, a clocked element, a capacitor and a resistor, a comparator, and an element with a delay controllable by one or more signals. These embodiments may also be representative of a delay means.

The stabilization capacitor Cch is coupled to an output terminal outputting the pixel power supply ELVDD of the first power supply unit 410 so that the pixel power supply ELVDD is charged in the stabilization capacitor Cch. Therefore, the output of the first power supply unit 410 can be stably output.

Figure 5:
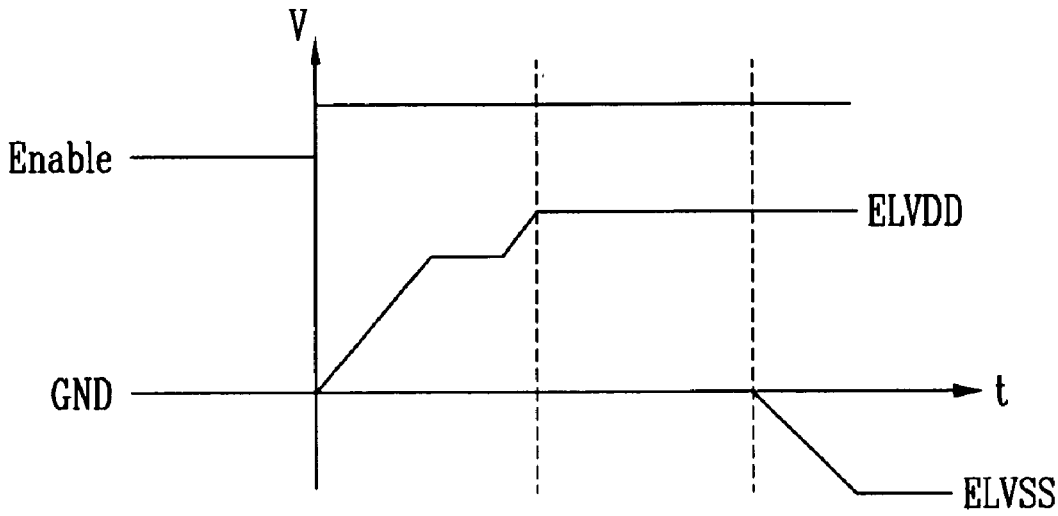
FIG. 5 is a graph showing an operation of a DC-DC converter of FIG. 4.

FIG. 5 is a graph showing an operation of a DC-DC converter of FIG. 4. Referring to FIG. 5, if enable signals Enable are input to the DC-DC converter as above, the enable signals Enable are delayed and input to a second power supply unit 420 with a delay element 430. Accordingly, the second power supply unit 420 is driven after a certain time elapses after a first power supply unit 410 is driven.

Accordingly, if the enable signals Enable are input to the DC-DC converter 400, the first power supply unit 410 operates to boost a predetermined voltage so that the pixel power supply ELVDD is first generated.

And, the second power supply unit 420 receives the enable signals after a certain time elapses after the first power supply unit 420 starts to operate so that the second power supply unit 420 is driven. Accordingly, a ground power supply ELVSS is generated. The second power supply 420 may generate the ground power supply ELVSS by dropping a voltage and may generate the ground power supply ELVSS by inverting the pixel power supply ELVDD.

If the pixel power supply ELVDD and the ground power supply ELVSS are simultaneously generated, the pixel power supply ELVDD is transferred to a source electrode of the first transistor and the ground power supply ELVSS is transferred to a cathode electrode of an organic light emitting diode OLED, in each pixel. Because a voltage is stored in a capacitor Cst of the pixel the first transistor M1 turns on, and accordingly, current flows from the pixel power supply ELVDD to the ground power supply ELVSS.

Therefore, the current flows on the organic light emitting diode OLED. However, in an initial starting, the voltage of the pixel power supply ELVDD gradually rises and the voltage of the ground power supply ELVSS gradually drops, in accordance with a time sequence. In other words, the voltage difference between the pixel power supply ELVDD and the ground power supply ELVSS is set to be different per each pixel line. Accordingly, the organic light emitting diodes OLED positioned on the lower portion row of the organic electroluminescence display have brightness higher than the organic light emitting diodes OLED positioned on the upper portion row thereof, showing glare.

In order to solve the problem as proposed above, the second power supply unit 420 starts to drive later than the first power supply unit 410 starts to drive. If the driving time of the second power supply unit 420 is later than that of the first power supply unit 410, the ground power supply ELVSS is not ready when the pixel power supply ELVDD is transferred to the pixel. Therefore, the voltage difference is not generated between the anode electrode and cathode electrode of the organic light emitting diode OLED so that the current does not flow on the organic light emitting diode OLED.

IF the ground power supply ELVSS is generated after the pixel power supply ELVDD is sufficiently high, the unevenness for the voltage difference between the pixel power supply ELVDD and the ground power supply ELVSS is prevented so that glare does not occur.

The delay element 430 delays enable signals Enable so that the second power supply unit 420 operates after the first power supply unit 410 completes the boosting of the pixel power supply ELVDD. The first power supply unit 410 completes the boosting within the time corresponding to a first frame so that the second power supply unit 420 starts to drive before the time corresponding to the first frame elapses. And, since a normal picture should be displayed starting from a second frame, the second power supply unit 420 completes the drop of the ground power supply ELVSS before the first frame is completed to allow the organic electroluminescence display to be stably driven thereafter.

Figure 6:
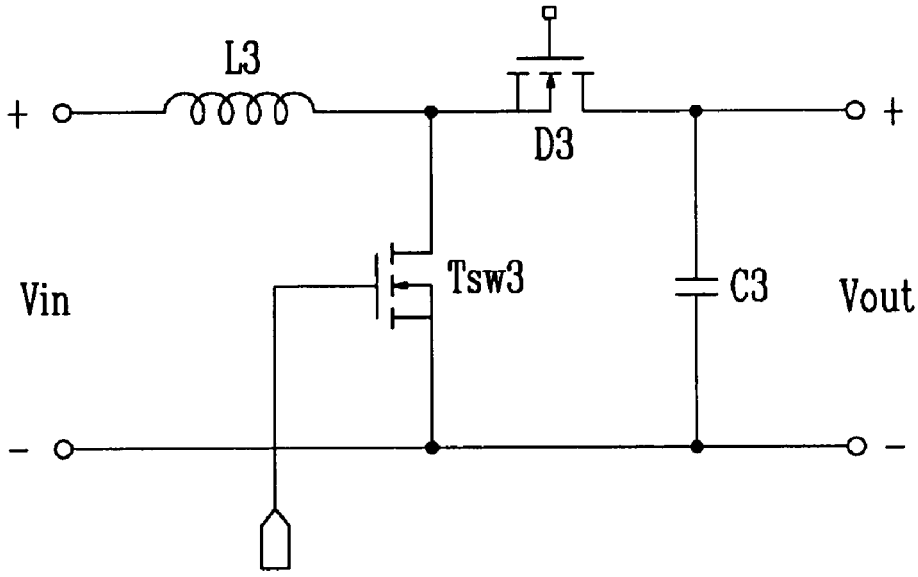
FIG. 6 is a schematic diagram of the first power supply unit of the power supply unit of FIG. 4.

FIG. 6 is a circuit view showing a first power supply unit of a power supply unit of FIG. 4. Referring to FIG. 6, the first power supply unit may comprise a boost circuit boosting and outputting voltage Vin input from a battery.

The boost circuit boosts and outputs Vout voltage transferred from the battery by charging generated from a coil L3 with diode D3 and capacitor C3 by receiving the voltage Vin.

Figure 7:
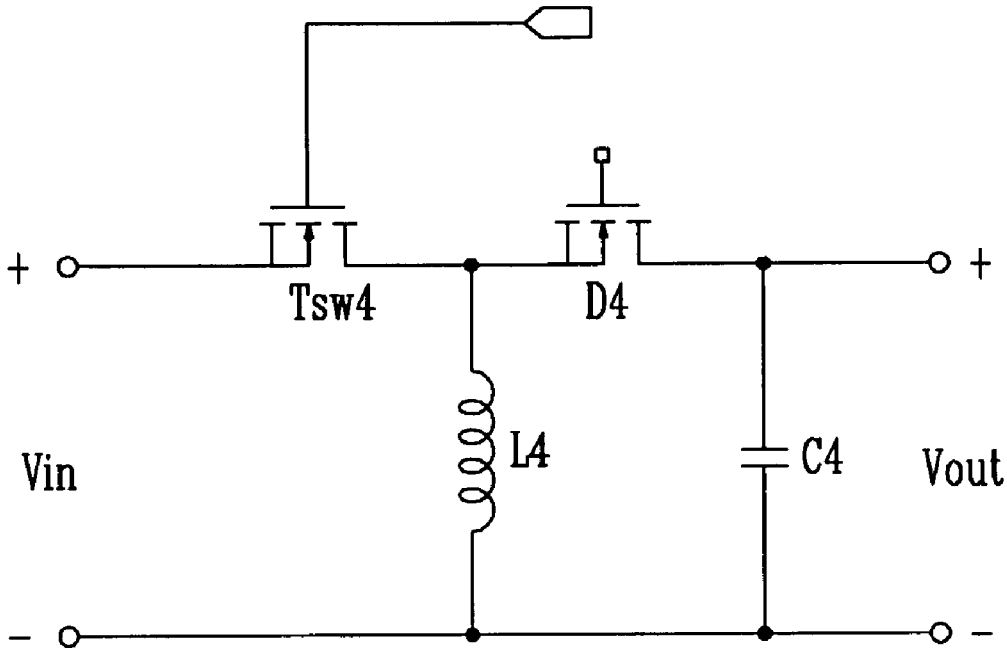
FIG. 7 is a schematic diagram of the second power supply unit of the power supply unit of FIG. 4.

FIG. 7 is a circuit view showing a second power supply unit of a power supply unit of FIG. 4. Referring to FIG. 7, the second power supply unit may comprise a buck boost circuit inverting and outputting voltage Vin output from a battery.

The buck boost circuit generates a ground power supply ELVSS by boosting or dropping the voltage Vin to be inverted with coil L4.

With an organic electroluminescence display and a driving method thereof according to the present invention, flashover at an initial driving thereof can be prevented. Also, the flashover is prevented, making it possible to reduce power consumption.

While the present invention has been described in connection with certain exemplary embodiments, it is to be understood that the invention is not limited to the disclosed embodiment, but, on the contrary, is intended to cover various modifications and equivalent arrangements.

What is claimed is:

1. An organic electroluminescence display, comprising:

a pixel unit configured to control current between a pixel power supply and a ground power supply according to data signals and scan signals, wherein light is emitted according to the amount of the current to display an image during each of a plurality of frame periods; and a DC-DC converter configured to generate and sequentially output the pixel power supply and the ground power supply, wherein the ground power supply is output after the pixel power supply, and the output pixel power supply and the output ground power supply are continuously applied to the pixel unit throughout each frame period, wherein the DC-DC converter comprises:

a first power supply unit configured to generate the pixel power supply after receiving enable signals and boosting an input voltage;

a second power supply unit configured to output the ground power supply after receiving the enable signals and dropping the input voltage;

a stabilization capacitor coupled to an output terminal of the first power supply unit and configured to stabilize the output voltage of the first power supply unit; and a delay element configured to delay the enable signals for a time before transferring them to the second power supply unit.

2. The organic electroluminescence display as claimed in claim 1, wherein the delay element is configured to transfer the enable signals the second power supply unit after the pixel power supply is stable.

3. The organic electroluminescence display as claimed in claim 1, wherein the second power supply unit generates the ground power supply by inverting the pixel power supply.

4. The organic electroluminescence display as claimed in claim 1, wherein the first power supply comprises a boost circuit.

5. The organic electroluminescence display as claimed in claim 1, wherein the second power supply comprises a buck boost circuit.

6. The organic electroluminescence display as claimed in claim 1, wherein the time between the beginning of the outputting of the pixel power supply and the time the ground power supply is substantially stable is less than a frame period of the display.

7. A driving method of an organic electroluminescence display, configured to generate light to display an image during each of a plurality of frame periods according to data signals, scan signals, a pixel power supply and a ground power supply, the driving method comprising:

generating the pixel power supply by boosting an input voltage according to enable signals;

generating the ground power supply after receiving the enable signals;

delaying the enable signals before generating the ground power supply; and continuously receiving the pixel power supply and the ground power supply throughout each frame period to generate the light.

8. The driving method of the organic electroluminescence display as claimed in claim 7, wherein the enable signals allow the ground power supply to be generated after the pixel power supply is stable.

9. The driving method of the organic electroluminescence display as claimed in claim 7, wherein the ground power supply is generated by inverting the pixel power supply.

10. The driving method of the organic electroluminescence display as claimed in claim 7, wherein the pixel power supply is generated using a boost circuit.

11. The driving method of the organic electroluminescence display as claimed in claim 7, wherein the ground power supply is generated using a buck boost circuit.

12. The driving method of the organic electroluminescence display as claimed in claim 7, wherein the time between the beginning of the outputting of the pixel power supply and the time the ground power supply is substantially stable is less than a frame period of the display.

13. An organic electroluminescence display, comprising:

a pixel unit configured to control current between a pixel power supply and a ground power supply, wherein light is emitted according to the amount of the current to display an image during each of a plurality of frame periods; and a DC-DC converter configured to sequentially output the pixel power supply and the ground power supply, wherein the ground power supply is output after a delay relative to the pixel power supply, and the output pixel power supply and the output ground power supply are continuously applied to the pixel unit throughout each frame period.

14. The organic electroluminescence display as claimed in claim 13, wherein the DC-DC converter comprises:

a first power supply unit configured to output the pixel power supply after receiving a supply enable signal;

a second power supply unit configured to output the ground power supply after receiving a ground enable signal;

a delay element configured to generate the ground enable signal after the delay with respect to the supply enable signal.

15. The organic electroluminescence display as claimed in claim 13, wherein the delay is long enough to allow the pixel power supply to be stable before the ground power supply is output.

16. The organic electroluminescence display as claimed in claim 13, wherein the DC-DC converter comprises a boost circuit configured to generate the pixel power supply.

17. The organic electroluminescence display as claimed in claim 13, wherein the DC-DC converter comprises a buck boost circuit configured to generate the ground power supply.

18. An organic electroluminescence display, configured to operate in response to data signals, scan signals, a pixel power supply and a ground power supply, the display comprising:

means for displaying an image;

means for supplying the pixel power supply to the means for displaying according to an enable signal;

means for supplying the ground power supply to the means for displaying according to the enable signal;

means for applying the enable signal to the means for supplying the pixel power supply and to the means for supplying the ground power supply; and means for delaying the enable signal before applying the enable signal to the means for supplying the ground power supply, wherein the means for supplying the pixel power supply to the means for displaying supplies the pixel power supply to the means for displaying before the means for supplying the ground power supply to the means for displaying supplies the ground power supply to the means for displaying.

19. The display as claimed in claim 18, wherein the pixel power supply is stable before the ground power supply is supplied to the means for displaying.

* * * * *